US008078455B2

(12) United States Patent
Shi et al.

(10) Patent No.: US 8,078,455 B2
(45) Date of Patent: Dec. 13, 2011

(54) APPARATUS, METHOD, AND MEDIUM FOR DISTINGUISHING VOCAL SOUND FROM OTHER SOUNDS

(75) Inventors: Yuan Yuan Shi, Beijing (CN); Yongbeom Lee, Seoul (KR); Jaewon Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1357 days.

(21) Appl. No.: 11/051,475

(22) Filed: Feb. 7, 2005

(65) Prior Publication Data

US 2005/0187761 A1 Aug. 25, 2005

(30) Foreign Application Priority Data

Feb. 10, 2004 (KR) ..... 10-2004-0008739

(51) Int. Cl.
*G10L 11/06* (2006.01)

(52) U.S. Cl. ..... 704/208; 209/214; 209/E11.003

(58) Field of Classification Search ..... 704/209, 704/214, E11.003, 208
See application file for complete search history.

(56) References Cited

U.S. PATENT DOCUMENTS 4,802,221 A * 1/1989 Jibbe ..... 704/208
5,197,113 A * 3/1993 Mumolo ..... 704/200
5,487,153 A * 1/1996 Hammerstrom et al. ..... 718/100
5,596,679 A * 1/1997 Wang ..... 704/236
5,611,019 A * 3/1997 Nakatoh et al. ..... 704/233
5,687,286 A * 11/1997 Bar-Yam ..... 704/232
5,809,455 A * 9/1998 Nishiguchi et al. ..... 704/214
5,913,194 A * 6/1999 Karaali et al. ..... 704/259
6,035,271 A * 3/2000 Chen ..... 704/207
6,188,981 B1 * 2/2001 Benyassine et al. ..... 704/233
6,556,967 B1 * 4/2003 Nelson et al. ..... 704/233
6,917,912 B2 * 7/2005 Chang et al. ..... 704/207
7,082,419 B1 * 7/2006 Lightowler ..... 706/15
2001/0021905 A1 * 9/2001 Burnett et al. ..... 704/233
2003/0216909 A1 * 11/2003 Davis et al. ..... 704/210
2004/0030555 A1 * 2/2004 van Santen ..... 704/260
2005/0088981 A1 * 4/2005 Woodruff et al. ..... 370/260
2005/0091044 A1 * 4/2005 Ramo et al. ..... 704/207
2005/0131688 A1 * 6/2005 Goronzy et al. ..... 704/240

OTHER PUBLICATIONS

R. Cai, L. Lu, H.-J. Zhang, and L.-H. Cai, "Using structure patterns of temporal and spectral feature in audio similarity measure," in Proc. 11th ACM Multimedia Conf., Berkeley, CA, Nov. 2003, pp. 219-222.*

(Continued)

*Primary Examiner* — Richemond Dorvil
*Assistant Examiner* — Greg Borsetti
(74) *Attorney, Agent, or Firm* — Staas & Halsey LLP

(57) ABSTRACT

An apparatus, method, and medium for distinguishing a vocal sound. The apparatus includes: a framing unit dividing an input signal into frames, each frame having a predetermined length; a pitch extracting unit determining whether each frame is a voiced frame or an unvoiced frame and extracting a pitch contour from the voiced and unvoiced frames; a zero-cross rate calculator respectively calculating a zero-cross rate for each frame; a parameter calculator calculating parameters including a time length ratio of the voiced frame and the unvoiced frame determined by the pitch extracting unit, statistical information of the pitch contour, and spectral characteristics; and a classifier inputting the zero-cross rates and the parameters output from the parameter calculator and determining whether the input signal is a vocal sound.

31 Claims, 6 Drawing Sheets

OTHER PUBLICATIONS

S. Yuan-Yuan, W. Xue, and S. Bin. Several features for discrimination between vocal sounds and other environmental sounds. In Proceedings of the European Signal Processing Conference, 2004.*

A. Bendiksen and K. Steiglitz. Neural Networks for voiced/unvoiced speech classification. Proceedings ICASSP-90, pp. 521-524, 1990.*

Yair E, Gath I. On the use of pitch power spectrum in the evaluation of vocal tremor. Proc IEEE. 1988;76:1166-1175.*

H. L. Van Trees, Detection Estimation, and Modulation Theory, Part III: Radar-Sonar Signal Processing and Gaussian Signals in Noise. New York: Wiley, 1971. pp. 568-571.*

R. Fisher, S. Perkins, A. Walker and E. Wolfart. Classification. 2003. retrieved Dec. 29, 2009 from (http://homepages.inf.ed.ac.uk/rbf/HIPR2/classify.htm).*

Kobatake et al. "Speech/Nonspeech Discrimination for Speech Recognition System Under Real Life Noise Environments" 1989.*

Lu et al. "A Robust Audio Classification and Segmentation Method" 2001.*

Godino-Llorente et al. "Automatic Detection of Voice Impairments by Means of Short-Term Cepstral Parameters and Neural Network Based Detectors" Jan. 30, 2004 as cited on IEEE.com.*

Wang et al. "Separation of Speech from Interfering Sounds Based on Oscillatory Correlation" 1999.*

Lu, L. et al., Content Analysis for Audio Classification and Segmentation, IEEE Transactions on Speech and Audio Processing, vol. 10, No. 7, Oct. 2002, pp. 504-516.

Classifier (mathematics), Wikipedia, http://en.wikipedia.org/wiki/Classifier_(mathematics).

Chinese Office Action dated Jul. 1, 2010 issued in Chinese Patent Application No. 200510008224.8.

* cited by examiner

FIG. 3A

| NO. | SIZE OF NEURAL NETWORK | TRAINING SET | MEN | TRAINING SET | MEN |
|---|---|---|---|---|---|
| | | | WOMEN | | WOMEN |
| | | | OTHER SOUNDS | | OTHER SOUNDS |
| 1 | [9 5 2 1] | 1e3 | | 9e4-1e3 | |
| | | 1e3 | | 9e4-1e3 | |
| | | 2e3 | | 8e5-2e3 | |
| 2 | [9 5 2 1] | 1e4 | | 9e4-1e4 | |
| | | 1e4 | | 9e4-1e4 | |
| | | 2e4 | | 8e5-2e4 | |
| 3 | [9 5 2 1] | 4e4 | | 9e4-4e4 | |
| | | 4e4 | | 9e4-4e4 | |
| | | 8e4 | | 8e5-8e4 | |
| 4 | [9 10 5 1] | 4e4 | | 9e4-4e4 | |
| | | 4e4 | | 9e4-4e4 | |
| | | 8e4 | | 8e5-8e4 | |
| 5 | [9 15 7 1] | 4e4 | | 9e4-4e4 | |
| | | 4e4 | | 9e4-4e4 | |
| | | 8e4 | | 8e5-8e4 | |
| 6 | [9 20 10 1] | 4e4 | | 9e4-4e4 | |
| | | 4e4 | | 9e4-4e4 | |
| | | 8e4 | | 8e5-8e4 | |
| 7 | [9 5 2 1] | 1e4 | | 9e4-1e4 | |
| | | 0 | | 9e4 | |
| | | 1e4 | | 8e5-1e4 | |

FIG. 3B

| NO. | SIZE OF NEURAL NETWORK | TRAINING SET | MEN | TRAINING SET | MEN |
|---|---|---|---|---|---|
| | | | WOMEN | | WOMEN |
| | | | OTHER SOUNDS | | OTHER SOUNDS |
| 8 | [9 10 5 1] | 4e4 | | 9e4-4e4 | |
| | | 0 | | 9e4 | |
| | | 4e4 | | 8e5-4e4 | |
| 9 | [9 20 10 1] | 4e4 | | 9e4-4e4 | |
| | | 0 | | 9e4 | |
| | | 4e4 | | 8e5-4e4 | |
| 10 | [9 5 2 1] | 0 | | 9e4 | |
| | | 1e4 | | 9e4-1e4 | |
| | | 1e4 | | 8e5-1e4 | |
| 11 | [9 10 5 1] | 0 | | 9e4 | |
| | | 4e4 | | 9e4-4e4 | |
| | | 4e4 | | 8e5-4e4 | |
| 12 | [9 20 10 1] | 0 | | 9e4 | |
| | | 4e4 | | 9e4-4e4 | |
| | | 4e4 | | 8e5-4e4 | |

FIG. 4

| NO. | DISTINGUISHING RATIO OF TEST SET | FALSE ALARM RATIO OF TEST SET | DISTINGUISHING RATIO OF TRAINING SET | FALSE ALARM RATIO OF TRAINING SET |
|---|---|---|---|---|
| 1 | 100% | 0 | 13.16% | 14.39% |
| 2 | 99.22% | 4.73% | 98.73% | 11% |
| 3 | 95.34% | 3.46% | 96.5% | 10.27% |
| 4 | 98.87% | 0.78% | 97.4% | 10.3% |
| 5 | 99.52% | 0.2% | 98% | 11.77% |
| 6 | 100% | 0.12% | 98% | 10.52% |
| 7 | 99.24% | 0.03% | 99.24% | 8.62% |
| 8 | 99.15% | 2.67% | 100% | 10% |
| 9 | 99.41% | 1.95% | 100% | 9.87% |
| 10 | 100% | 0.93% | 98.6% | 7% |
| 11 | 98.9% | 0.67% | 99.8% | 7.85% |
| 12 | 99% | 1.32% | 99.86% | 8% |

APPARATUS, METHOD, AND MEDIUM FOR DISTINGUISHING VOCAL SOUND FROM OTHER SOUNDS

CROSS-REFERENCE TO RELATED APPLICATIONS

This application claims the benefit of Korean Patent Application No. 10-2004-0008739, filed on Feb. 10, 2004, in the Korean Intellectual Property Office, the disclosure of which is incorporated herein in its entirety by reference.

BACKGROUND OF THE INVENTION

1. Field of the Invention

The present invention relates to an apparatus, method, and medium for distinguishing a vocal sound, and more particularly, to an apparatus, method, and medium for distinguishing a vocal sound from various sounds.

2. Description of the Related Art

Identification of vocal sounds from other sounds is an actively studied subject. The identification may be resolved in a sound recognition field. The sound recognition may be performed to automatically understand the origin of environmental sounds. For example, the sound identification may be performed to automatically understand the origin of all types of environmental sounds including human sounds and the environmental or natural sounds. That is, the sound recognition may be performed to identify the sources of the sounds, for example, a person's voice or an impact sound generated from a piece of glass broken on a floor. Semantic meaning similar to human understanding can be established on the basis of the identification of the sound sources. Therefore, the identification of the sound sources is the first object of sound recognition technology.

Sound recognition deals with a much broader sound field than speech recognition because nobody can determine how many kinds of sounds exist in the world. Therefore, sound recognition focuses on limited sound sources closely related to potential applications or functions of sound recognition systems to be developed.

There are various kinds of sounds to be recognized. As examples of sounds that can be generated at home, there may be a simple sound generated by a hard stick tapping a piece of glass, or a complex sound generated by an explosion. Other examples of sounds include a sound generated by a coin bouncing on a floor; verbal sounds such as speaking; non-verbal sounds such as laughing, crying, and screaming; sounds generated by human actions or movements; and sounds ordinarily generated from a kitchen, a bathroom, bedrooms, or home appliances.

Because the number of types of sounds is infinite, there is a need for an apparatus, method, and medium for effectively distinguishing a vocal sound generated by a person from various kinds of sounds.

SUMMARY OF THE INVENTION

Embodiments of the present invention provide an apparatus, method, and medium for distinguishing a vocal sound from a non-vocal sound by extracting pitch contour information from an input audio signal, extracting a plurality of parameters from an amplitude spectrum of the pitch contour information, and using the extracted parameters in a predetermined manner.

Additional aspects and/or advantages of the invention will be set forth in part in the description which follows and, in part, will be obvious from the description, or may be learned by practice of the invention.

To achieve the above and/or other aspects and advantages, embodiments of the present invention include an apparatus for distinguishing a vocal sound, the apparatus including a framing unit dividing an input signal into frames, each frame having a predetermined length, a pitch extracting unit determining whether each frame is a voiced frame or an unvoiced frame and extracting a pitch contour from the frame, a zero-cross rate calculator respectively calculating a zero-cross rate for each frame; a parameter calculator calculating parameters including a time length ratio with respect to the voiced frame and unvoiced frame determined by the pitch extracting unit, statistical information of the pitch contour, and spectral characteristics, and a classifier inputting the zero-cross rates and the parameters output from the parameter calculator and determining whether the input signal is a vocal sound.

The parameter calculator may further include a voiced frame/unvoiced frame (V/U) time length ratio calculator obtaining a time length of the voiced frame and a time length of the unvoiced frame and calculating a time length ratio by dividing the voiced frame time length by the unvoiced frame time length, a pitch contour information calculator calculating the statistical information including a mean and variance of the pitch contour, and a spectral parameter calculator calculating the spectral characteristics with respect to an amplitude spectrum of the pitch contour.

The V/U time length ratio calculator may further calculate a local V/U time length ratio, which is a time length ratio of a single voiced frame to a single unvoiced frame, and a total V/U time length ratio, which is a time length ratio of total voiced frames to total unvoiced frames.

The V/U time length ratio calculator may further include a total frame counter and a local frame counter, the V/U time length ratio calculator resets the total frame counter whenever a new signal is input or whenever a preceding signal segment is ended, and the V/U time length ratio calculator resets the local frame counter when the input signal transitions from the voiced frame to the unvoiced frame.

The V/U time length ratio calculator may further update the total V/U time length ratio once every frame and the local V/U time length ratio whenever the input signal transitions from the voiced frame to the unvoiced frame.

The pitch contour information calculator may initialize a mean and variance of the pitch contour whenever a new signal is input or whenever a preceding signal segment is ended.

The pitch contour information calculator may initialize a mean and variance with a pitch value of a first frame and a square of the pitch value of the first frame, respectively.

The pitch contour information calculator, after the mean and variance of the pitch contour is initialized, may update the mean and the variance of the pitch contour as follows:

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

where, u(Pt, t) indicates a mean of the pitch contour during a t time, N indicates the number of counted frames, u2(Pt, t) indicates a square value of the mean, var(Pt, t) indicates a variance of the pitch contour at time t, and a pitch contour Pt indicates a pitch value when an input frame is a voiced frame and zero when the input frame is an unvoiced frame.

The spectral parameter calculator may perform a fast Fourier transform (FFT) of an amplitude spectrum of the pitch contour and obtains a centroid C, a bandwidth B, and a spectral roll-off frequency (SRF) with respect to a result f(u) of the FFT as follows:

$$C = \frac{\sum_{u=0}^{u=15} u|f(u)|^2}{\sum_{u=0}^{u=15} |f(u)|^2}$$

$$B = \frac{\sum_{u=0}^{u=15} (u-C)^2|f(u)|^2}{\sum_{u=0}^{u=15} |f(u)|^2}$$

$$SRF = \max\left(h \left| \sum_{u=0}^{h} f(u) < 0.85 * \sum_{u=0}^{15} f(u)\right.\right)$$

The classifier may be a neural network including a plurality of layers each having a plurality of neurons, determining whether or not the input signal is a vocal sound, using parameters output from the zero-cross rate calculator and parameter calculator, based on a result of training in order to distinguish the vocal sound.

The classifier further includes a synchronization unit synchronizing the parameters.

To achieve the above and/or other aspects and advantages, embodiments of the present invention may also include a method of distinguishing a vocal sound, the method includes dividing an input signal into frames, each frame having a predetermined length, determining whether each frame is a voiced frame or an unvoiced frame and extracting a pitch contour of the frame, calculating a zero-cross rate for each frame, calculating parameters including a time length ratio with respect to the determined voiced frame and unvoiced frame, statistical information of the pitch contour, and spectral characteristics, and determining whether the input signal is the vocal sound using the calculated parameters.

The calculating of the time length ratio may include calculating a local V/U time length ratio, which is a time length ratio of a single voiced frame to a single unvoiced frame, and a total V/U time length ratio, which is a time length ratio of total voiced frames to total unvoiced frames.

The numbers of voiced and unvoiced frames accumulated and counted to calculate the total V/U time length ratio may be reset whenever a new signal is input or whenever a preceding signal segment is ended and the numbers of voiced and unvoiced frames accumulated and counted to calculate the local V/U time length ratio are reset whenever the input signal transitions from the voiced frame to the unvoiced frame.

The total V/U time length ratio may be updated once every frame and the local V/U time length ratio is updated whenever the input signal transitions from the voiced frame to the unvoiced frame.

The statistical information of the pitch contour includes a mean and variance of the pitch contour and the mean and variance of the pitch contour are initialized whenever a new signal is input or whenever a preceding signal segment is ended.

The initialization of the mean and variance of the pitch contour may be performed with a pitch value of a first frame and a square of the pitch value of the first frame, respectively.

The mean and the variance of the pitch contour may be updated as follows:

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

where, u(Pt, t) indicates a mean of the pitch contour at time t, N indicates the number of counted frames, u2(Pt, t) indicates a square value of the mean, var(Pt, t) indicates a variance of the pitch contour at time t, and a pitch contour Pt indicates a pitch value when an input frame is a voiced frame and zero when the input frame is an unvoiced frame.

The spectral characteristics include a centroid, a bandwidth, and/or a spectral roll-off frequency with respect to an amplitude spectrum of the pitch contour, and the calculating of the spectral characteristics includes performing a fast Fourier transform (FFT) of the amplitude spectrum of the pitch contour, and obtaining the centroid C, the bandwidth B, and the spectral roll-off frequency (SRF) with respect to a result f(u) of the FFT as follows:

$$C = \frac{\sum_{u=0}^{u=15} u|f(u)|^2}{\sum_{u=0}^{u=15} |f(u)|^2}$$

$$B = \frac{\sum_{u=0}^{u=15} (u-C)^2|f(u)|^2}{\sum_{u=0}^{u=15} |f(u)|^2}$$

$$SRF = \max\left(h \left| \sum_{u=0}^{h} f(u) < 0.85 * \sum_{u=0}^{15} f(u)\right.\right)$$

The determining of the input signal to be the vocal sound may include training a neural network by inputting predetermined parameters including a zero-cross rate, a time length ratio with respect to a voiced frame and unvoiced frame, statistical information of a pitch contour, and spectral characteristics from predetermined voice signals to the neural network and comparing an output of the neural network with a predetermined value so as to classify a signal having characteristics of the predetermined parameters as a voice signal; extracting parameters including a zero-cross rate, a time length ratio with respect to a voiced frame and unvoiced frame, statistical information of a pitch contour, and spectral characteristics from the input signal; inputting the parameters extracted from the input signal to the trained neural network; and determining whether the input signal is the vocal sound by comparing an output of the neural network and the predetermined reference value.

The determining of the vocal sound may further includes synchronizing the parameters.

To achieve the above and/or other aspects and advantages, embodiments of the present invention include a medium including: computer-readable instructions, for distinguishing a vocal sound, including dividing an input signal into frames, each frame having a predetermined length; determining whether each frame is a voiced frame or an unvoiced frame and extracting a pitch contour of the frame; calculating a zero-cross rate for each frame; calculating parameters including a time length ratio with respect to the determined voiced frame and unvoiced frame, statistical information of the pitch contour, and spectral characteristics; and determining whether the input signal is the vocal sound using the calculated parameters.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 3A and 3B are tables illustrating training and test sets used for twelve (12) tests;

FIG. 4 is a table illustrating a test result according to tables of FIGS. 3A and 3B;

DETAILED DESCRIPTION OF THE PREFERRED EMBODIMENTS

Figure 1:
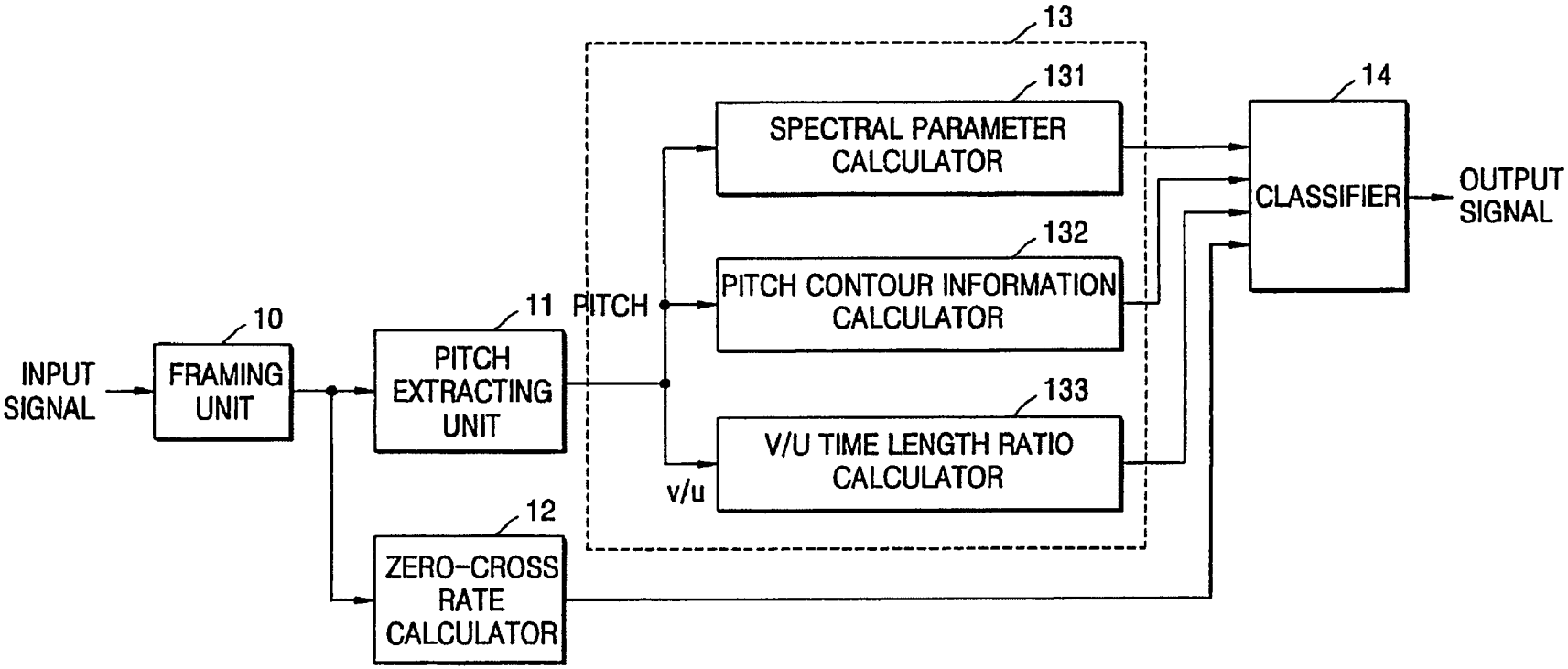
FIG. 1 is a block diagram of an apparatus for distinguishing a vocal sound according to an exemplary embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

FIG. 1 is a block diagram of an apparatus for distinguishing a vocal sound according to an exemplary embodiment of the present invention. Referring to FIG. 1, the apparatus for distinguishing a vocal sound includes a framing unit 10, a pitch extracting unit 11, a zero-cross rate calculator 12, a parameter calculator 13, and a classifier 14.

The parameter calculator 13 includes a spectral parameter calculator 131, a pitch contour information calculator 132, and a voiced frame/unvoiced frame (V/U) time length ratio calculator 133.

The framing unit 10 divides an input audio signal into a plurality of frames, wherein each frame is preferably a short-term frame indicating a windowing processed data segment. A window length of each frame is preferably 10 ms to 30 ms, most preferably 20 ms, and preferably corresponds to more than two pitch periods. A framing process may be achieved by shifting a window by a frame step in a range of 50%-100% of the frame length. In the frame step of the present exemplary embodiment, 50% of the frame length, i.e., 10 ms, is used.

Figure 2:
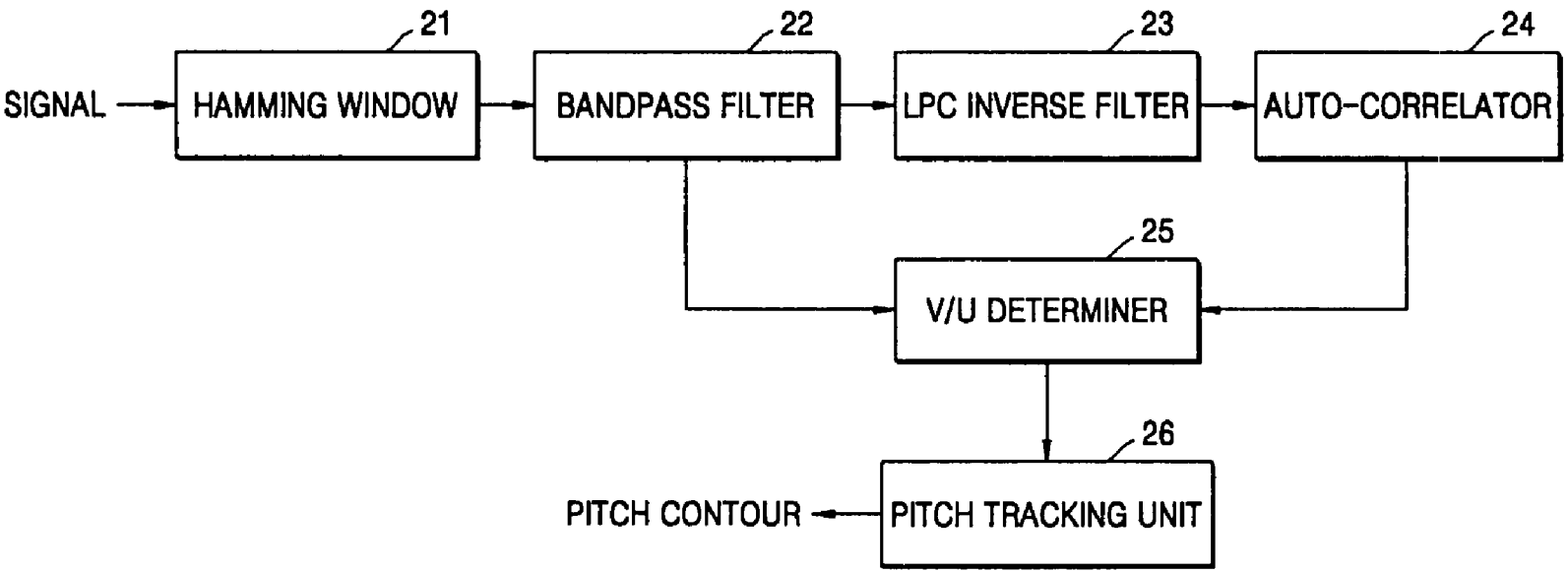
FIG. 2 CONVENTIONAL ART
FIG. 2 is a detailed block diagram of an LPC10 apparatus.

The pitch extracting unit 11 preferably extracts pitches for each frame. Any pitch extracting method can be used for the pitch extraction. The present exemplary embodiment adopts a simplified pitch tracker of a conventional $10^{th}$ order linear predictive coding method (LPC10) as the pitch extracting method. FIG. 2 is a detailed block diagram of an LPC10 apparatus. A hamming window 21 is applied to frames of a signal. A band pass filter 22 passes 60-900 Hz band signals among output signals of the hamming window 21. An LPC inverse filter 23 outputs LPC residual signals of the band-passed signals. An auto-correlator 24 auto-correlates the LPC residual signals and selects 5 peak values among the auto-correlated results. A V/U determiner 25 determines whether a current frame is a voiced frame or an unvoiced frame using the band-passed signals, the auto-correlated results, and the peak values of the residual signals for frames. A pitch tracking unit 26 tracks a fundamental frequency, i.e., a pitch, from 3 preceding frames using a dynamic programming method on the basis of a V/U determined result and 5 peak values. Finally, the pitch tracking unit 26 extracts a pitch contour by concatenating a pitch tracking result of the voiced frame if the frame is determined to be the voiced frame or pitch 0 of the unvoiced frame if the frame is determined to be the unvoiced frame.

The zero-cross rate calculator 12 calculates a zero-cross rate of a frame with respect to all frames.

The parameter calculator 13 outputs characteristic values on the basis of the extracted pitch contour. The spectral parameter calculator 131 calculates spectral characteristics from an amplitude spectrum of the pitch contour output from the pitch extracting unit 11. The spectral parameter calculator 131 calculates a centroid, a bandwidth, and a roll-off frequency from the amplitude spectrum of the pitch contour by performing 32-point fast Fourier transform (FFT) of the pitch contour once every 0.3 seconds. Here, the roll-off frequency indicates a frequency when the amplitude spectrum of the pitch contour drops from a maximum power to a power below 85% of the maximum power.

When f(u) indicates a 32-point fast Fourier transform (FFT) spectrum of an amplitude spectrum of a pitch contour, a centroid C, a bandwidth B, and a spectral roll-off frequency (SRF) can be calculated as shown in Equation 1.

Equation 1

$$C = \frac{\sum_{u=0}^{u=15} u|f(u)|^2}{\sum_{u=0}^{u=15} |f(u)|^2}$$

$$B = \frac{\sum_{u=0}^{u=15} (u-C)^2|f(u)|^2}{\sum_{u=0}^{u=15} |f(u)|^2}$$

$$SRF = \max\left(h \left| \sum_{u=0}^{h} f(u) < 0.85 * \sum_{u=0}^{15} f(u)\right.\right)$$

The pitch contour information calculator 132 calculates a mean and a variance of the pitch contour. The pitch contour information is initialized whenever a new signal is input or whenever a preceding signal is ended. A pitch value of a first frame is set to an initial mean value, and a square of the pitch value of the first frame is set to an initial variance value.

After the initialization is performed, the pitch contour information calculator 132 updates the mean and the variance of the pitch contour every frame step, at every 10 ms in the present embodiment, in a frame unit as presented in Equation 2.

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

Equation 2

Here, u(Pt, t) indicates a mean of the pitch contour at time t, N the number of counted frames, u2(Pt, t) a square value of the mean, var(Pt, t) a variance of the pitch contour at time t, respectively. A pitch contour, Pt, indicates a pitch value when an input frame is a voiced frame and 0 when the input frame is an unvoiced frame.

The V/U time length ratio calculator 133 calculates a local V/U time length ratio and a total V/U time length ratio. The local V/U time length ratio indicates a time length ratio of a single voiced frame to a single unvoiced frame, and the total V/U time length ratio indicates a time length ratio of total voiced frames to total unvoiced frames.

The V/U time length ratio calculator 133 includes a total frame counter (not shown) separately counting accumulated voiced and unvoiced frames to calculate the total V/U time length ratio and a local frame counter (not shown) separately counting voiced and unvoiced frames of each frame to calculate the local V/U time length ratio.

The total V/U time length ratio is initialized by resetting the total frame counter whenever a new signal is input or whenever a preceding signal segment is ended, and updated in a frame unit. In this exemplary embodiment, the signal segment represents a signal having a larger energy than a background sound without limitation of a duration of time.

The local V/U time length ratio is initialized by resetting the local frame counter when a voiced frame is ended and a succeeding unvoiced frame starts. When the initialization is performed, the local V/U time length ratio is calculated from a ratio of the voiced frame to the voiced frame plus the unvoiced frame. Also, the local V/U time length ratio is preferably updated whenever a voiced frame is transferred to an unvoiced frame.

Figure 6:
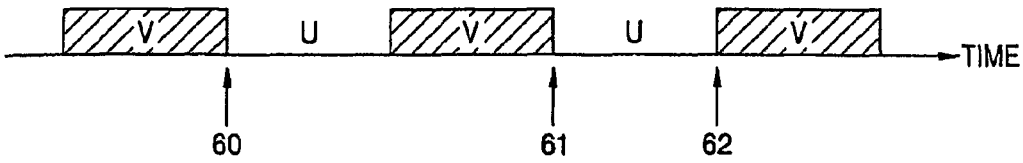
FIG. 6 illustrates a time of updating a local voiced/unvoiced V/U time length ratio when voiced frames and unvoiced frames are mixed.

FIG. 6 illustrates a time of updating a local V/U time length ratio when voiced frames and unvoiced frames are mixed. Referring to the example in FIG. 6, V indicates a voiced frame, and U indicates an unvoiced frame. A reference number 60 indicates a time of updating a local V/U time length ratio, that is, a time of transferring from a voiced frame to an unvoiced frame. A reference number 61 indicates a time of updating an unvoiced time length, and a reference number 62 indicates a time of waiting for counting a voiced time length. The total V/U time length ratio V/U_GTLR is obtained as shown in Equation 3.

$$V/\mathrm{U_GTLR} = \frac{N_V}{N_V + N_U};$$

$$N_V{+}{+}, \text{ if } V$$

$$N_U{+}{+}, \text{ if } U$$

Equation 3

Here, $N_v$ and $N_u$ indicate the number of voiced frames and the number of unvoiced frames, respectively.

The classifier 14 takes inputs of various kinds of parameters output from the spectral parameter calculator 131, the pitch contour information calculator 132, the V/U time length ratio calculator 133, and the zero-cross rate calculator 12 and finally determines whether or not the input audio signal is a vocal sound.

In this exemplary embodiment, the classifier 14 can further include a synchronization unit (not shown) at its input side. The synchronization unit synchronizes parameters input to the classifier 14. The synchronization may be necessary since each of the parameters is updated at a different time. For example, the zero-cross rate, the mean and variance values of a pitch contour, and the total V/U time length ratio are preferably updated once every 10 ms, and spectral parameters of an amplitude spectrum of the pitch contour are preferably updated once every 0.3 seconds. The local V/U time length ratio is randomly updated whenever a frame is transferred from a voiced frame to an unvoiced frame. Therefore, if new values are not updated in the input side of the classifier 14 at present, preceding values are provided as the input values, and if new values are input, after the new values are synchronized, the synchronized values are provided as the new input values.

A neural network is preferably used as the classifier 14. In the present exemplary embodiment, a feed-forward multilayer perceptron having 9 input neurons and 1 output neuron is used as the classifier 14. Middle layers can be selected such as a first layer having 5 neurons and a second layer having 2 neurons. The neural network is trained in advance so that an already known voice signal is classified as a voice signal using 9 parameters extracted from the already known voice signal. When the training is finished, the neural network determines whether an audio signal to be classified is the voice signal using 9 parameters extracted from the audio signal to be classified. An output value of the neural network indicates a posterior probability of whether a current signal is the voice signal. For example, if it is assumed that an average decision value of the posterior probability is 0.5, when the posterior probability is larger than or the same as 0.5, the current signal is determined as the voice signal, and when the posterior probability is smaller than 0.5, the current signal is determined as some other signal but the voice signal.

Table 1 shows results obtained on the basis of a surrounding environment sound recognition database collected from 21 sound effect CDs and a real world computing partnership (RWCP) database. A data set is a monotone, a sampling rate is 16, and the size of each data is 16 bits. Over 200 tokens from a single word to a several minute-long monologue with respect to men's voice including conversation, reading, and broadcasting with various languages including English, French, Spanish, and Russian are collected.

TABLE 1

| Contents | | Token |
|---|---|---|
| Broadcasting | | 50 |
| French broadcasting | | 10 |
| Conversation | English | 50 |
| | French | 20 |
| | Spanish | 10 |
| | Italian | 5 |
| | Japanese | 2 |
| | German | 2 |
| | Russian | 2 |
| | Hungarian | 2 |
| | Jewish | 2 |
| | Cantones | 2 |
| Speakings | | 60 |

In this example, the broadcasting includes news, weather reports, traffic updates, commercial advertisements, and sports news, and the French broadcasting includes news and weather reports. The sounds include vocal sounds generated from situations related to a law court, a church, a police station, a hospital, a casino, a movie theater, nursery, and traffic.

Table 2 shows the number of tokens obtained with respect to women's voice.

TABLE 2

| Contents | | Token |
|---|---|---|
| Broadcasting | | 30 |
| News broadcasting with other languages | | 16 |
| Conversation | English | 70 |
| | Italian | 10 |
| | Spanish | 20 |
| | Russian | 7 |
| | French | 8 |
| | Swedish | 2 |
| | German | 2 |
| | Chinese (Mandarin) | 3 |
| | Japanese | 2 |
| | Arabian language | 1 |
| Speech | | 50 |

In this example, the other languages for news broadcasting include Italian, Chinese, Spanish, and Russian, and the sounds include vocal sounds generated from situations related to a police station, a movie theater, traffic, and a call center.

Other sounds except vocal sounds include sounds generated from sound sources including furniture, home appliances, and utilities in a house, various kinds of impact sounds, and sounds generated from foot and arm movements.

Table 3 shows some additional details.

TABLE 3

| | Men's voice | Women's voice | Other sounds |
|---|---|---|---|
| Token | 217 | 221 | 4000 |
| Frame | 9e4 | 9e4 | 8e5 |
| Time | 1 h | 1 h | 8 h |

This example uses different training and test sets. FIGS. 3A and 3B are tables illustrating training and test sets used for 12 tests. In FIGS. 3A and 3B, the size of neural network indicates the number of input neurons, the number of neurons of a first middle layer, the number of neurons of a second middle layer, and the number of output neurons.

FIG. 4 is a table of illustrating test results according to tables of FIGS. 3A and 3B. In FIG. 4, a false alarm rate indicates a time percentage when a test signal is determined as a vocal sound even if it is not.

Referring to FIG. 4, a seventh test result shows the best performance. A first test result where the neural network is trained using 1000 human vocal sound samples and 2000 other sound samples does not show a sufficiently distinguishing vocal sound performance. Other test results where 10000 to 80000 training samples were used show similar distinguishing voice signal (vocal sound) performances.

Figure 5:
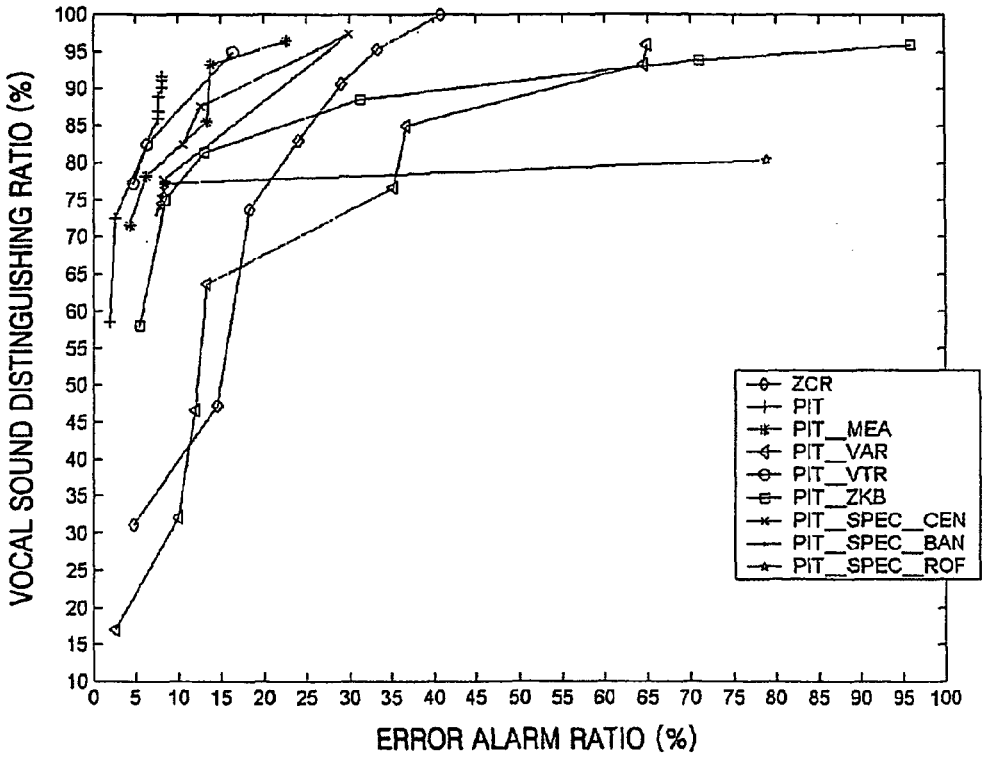
FIG. 5 is a graph illustrating distinguishing vocal sound performances for nine (9) features input to a neural network.

FIG. 5 is a graph illustrating distinguishing vocal sound performances for nine (9) features input to a neural network. In FIG. 5, ZCR indicates a zero-cross rate, PIT a pitch of a frame, PIT_MEA a mean of a pitch contour, PIT_VAR a variance of a pitch contour, PIT_VTR a total V/U time length ratio, PIT_ZKB a local V/U time length ratio, PIT_SPE_CEN a centroid of an amplitude spectrum of a pitch contour, PIT_SPE_BAN a bandwidth of an amplitude spectrum of a pitch contour, and PIT_SPE_ROF a roll-off frequency of an amplitude spectrum of a pitch contour, respectively. Referring to FIG. 5, PIT and PIT_VTR show better performances than the others.

As described above, according to the present exemplary embodiment, an improved distinguishing vocal sound performance of a vocal sound, such as a laughter or a cry as well as speech, can be obtained by extracting a centroid, a bandwidth, and a roll-off frequency from an amplitude spectrum of pitch contour information besides the pitch contour information and using them as inputs of a classifier. Therefore, the present exemplary embodiment can be used for security systems of offices and houses and also for a preprocessor detecting a start of a speech using pitch information in a voice recognition system. The present exemplary embodiment can further be used for a voice exchange system distinguishing vocal sounds from other sounds in a communication environment.

Exemplary embodiments may be embodied in a general-purpose computing devices by running a computer readable code from a medium, e.g. computer-readable medium, including but not limited to storage media such as magnetic storage media (ROMs, RAMs, floppy disks, magnetic tapes, etc.), and optically readable media (CD-ROMs, DVDs, etc.). Exemplary embodiments may be embodied as a computer-readable medium having a computer-readable program code unit embodied therein for causing a number of computer systems connected via a network to effect distributed processing. The network may be a wired network, a wireless network or any combination thereof. The functional programs, codes and code segments for embodying the present invention may be easily deducted by programmers in the art which the present invention belongs to.

While the above exemplary embodiments provide variable length coding of the input video data, it will be understood by those skilled in the art that fixed length coding of the input video data may be embodied from the spirit and scope of the invention.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An apparatus for distinguishing a vocal sound, the apparatus comprising:

a framing unit to divide an input signal into frames, each frame having a predetermined length;

a pitch extracting unit to determine whether each frame is a voiced frame or an unvoiced frame and extracting a pitch contour from the frame;

a zero-cross rate calculator to respectively calculate a zero-cross rate for each frame using a computing device;

a parameter calculator to calculate parameters including time length ratios with respect to the voiced frame and unvoiced frame determined by the pitch extracting unit, statistical information of the pitch contour, and spectral characteristics, wherein the time length ratios include a local voiced frame/unvoiced frame time length ratio, which is a time length ratio of a single voiced frame to a single unvoiced frame, and a total voiced frame/unvoiced frame time length ratio, which is a time length ratio of total voiced frames to total unvoiced frames; and a classifier to determine whether the input signal is a vocal sound using the calculated zero-cross rates and the calculated parameters output from the parameter calculator, wherein the calculated parameters output from the parameter calculator are the local voiced frame/unvoiced frame time length ratio, the total voiced frame/unvoiced frame time length ratio, the statistical information, and the spectral characteristics.

2. The apparatus of claim 1, wherein the parameter calculator comprises:

a voiced frame/unvoiced frame (V/U) time length ratio calculator to obtain the time length of the voiced frame and the time length of the unvoiced frame and to calculate the time length ratios by using the voiced frame time length and the unvoiced frame time length;

a pitch contour information calculator to calculate the statistical information including a mean and variance of the pitch contour; and a spectral parameter calculator to calculate the spectral characteristics with respect to an amplitude spectrum of the pitch contour.

3. The apparatus of claim 2, wherein the V/U time length ratio calculator calculates the local V/U time length ratio and the total V/U time length ratio.

4. The apparatus of claim 3, wherein the V/U time length ratio calculator includes a total frame counter and a local frame counter, the V/U time length ratio calculator resets the total frame counter whenever a new signal is input or whenever a preceding signal segment is ended, and the V/U time length ratio calculator resets the local frame counter when the input signal transitions from the voiced frame to the unvoiced frame.

5. The apparatus of claim 3, wherein the V/U time length ratio calculator updates the total V/U time length ratio once every frame and the local V/U time length ratio whenever the input signal transitions from the voiced frame to the unvoiced frame.

6. The apparatus of claim 2, wherein the pitch contour information calculator initializes a mean and variance of the pitch contour whenever a new signal is input or whenever a preceding signal segment is ended.

7. The apparatus of claim 6, wherein the pitch contour information calculator initializes a mean and variance with a pitch value of a first frame and a square of the pitch value of the first frame, respectively.

8. The apparatus of claim 6, wherein the pitch contour information calculator, after the mean and variance of the pitch contour is initialized, updates the mean and the variance of the pitch contour as follows:

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

where, u(Pt, t) indicates a mean of the pitch contour during at time, N indicates the number of counted frames, u2(Pt, t) indicates a square value of the mean, var(Pt, t) indicates a variance of the pitch contour at time t, and a pitch contour Pt indicates a pitch value when an input frame is a voiced frame and zero when the input frame is an unvoiced frame.

9. The apparatus of claim 2, wherein the spectral parameter calculator performs a fast Fourier transform (FFT) of an amplitude spectrum of the pitch contour and obtains a centroid C, a bandwidth B, and a spectral roll-off frequency (SRF) with respect to a result f(u) of the FFT as follows:

$$C = \frac{\sum_{\mu=0}^{\mu=15} u|f(u)|^2}{\sum_{\mu=0}^{\mu=15} u|f(u)|^2}$$

$$B = \frac{\sum_{\mu=0}^{\mu=15} (u-C)^2|f(u)|^2}{\sum_{\mu=0}^{\mu=15} |f(u)|^2}$$

$$\mathrm{SRF} = \max\left(h \,\middle|\, \sum_{\mu=0}^{h} f(u) < 0.85 * \sum_{\mu=0}^{15} f(u)\right)$$

10. The apparatus of claim 1, wherein the classifier is a neural network including a plurality of layers each having a plurality of neurons, determining whether or not the input signal is a vocal sound, using parameters output from the zero-cross rate calculator and parameter calculator, based on a result of training in order to distinguish the vocal sound.

11. The apparatus of claim 10, wherein the classifier further comprises:

a synchronization unit to synchronize the parameters.

12. A method of distinguishing a vocal sound, the method comprising:

dividing an input signal into frames, each frame having a predetermined length;

determining whether each frame is a voiced frame or an unvoiced frame and extracting a pitch contour of the frame;

calculating a zero-cross rate for each frame;

calculating parameters including time length ratios with respect to the determined voiced frame and unvoiced frame, statistical information of the pitch contour, and spectral characteristics, wherein the time length ratios include a local V/U time length ratio, which is a time length ratio of a single voiced frame to a single unvoiced frame, and a total V/U time length ratio, which is a time length ratio of total voiced frames to total unvoiced frames;

determining whether the input signal is the vocal sound using the calculated parameters calculated, the calculated parameters are the zero-cross rate, the local V/U time length ratio, the total V/U time length ratio, the statistical information, and the spectral characteristics, wherein the method is performed using at least one computing device.

13. The method of claim 12, wherein the calculating of the time length ratio comprises:

calculating the local V/U time length ratio and the total V/U time length ratio.

14. The method of claim 13, wherein the numbers of voiced and unvoiced frames accumulated and counted to calculate the total V/U time length ratio are reset whenever a new signal is input or whenever a preceding signal segment is ended, and the numbers of voiced and unvoiced frames accumulated and counted to calculate the local V/U time length ratio are reset whenever the input signal transitions from the voiced frame to the unvoiced frame.

15. The method of claim 14, wherein the total V/U time length ratio is updated once every frame and the local V/U time length ratio is updated whenever the input signal transitions from the voiced frame to the unvoiced frame.

16. The method of claim 12, wherein the statistical information of the pitch contour comprises a mean and variance of the pitch contour and the mean and variance of the pitch contour are initialized whenever a new signal is input or whenever a preceding signal segment is ended.

17. The method of claim 16, wherein initialization of the mean and variance of the pitch contour is performed with a pitch value of a first frame and a square of the pitch value of the first frame, respectively.

18. The method of claim 17, wherein the mean and the variance of the pitch contour are updated as follows:

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

where, u(Pt, t) indicates a mean of the pitch contour at time t, N indicates the number of counted frames, u2(Pt, t) indicates a square value of the mean, var(Pt, t) indicates a variance of the pitch contour at time t, and a pitch contour Pt indicates a pitch value when an input frame is a voiced frame and zero when the input frame is an unvoiced frame.

19. The method of claim 12, wherein the spectral characteristics include a centroid, a bandwidth, and/or a spectral roll-off frequency with respect to an amplitude spectrum of the pitch contour, and the calculating of the spectral characteristics comprises:

performing a fast Fourier transform (FFT) of the amplitude spectrum of the pitch contour, and obtaining the centroid C, the bandwidth B, and the spectral roll-off frequency (SRF) with respect to a result f(u) of the FFT as follows:

$$C = \frac{\sum_{u=0}^{u=15} u|f(u)|^2}{\sum_{u=0}^{u=15} |f(u)|^2}$$

$$B = \frac{\sum_{u=0}^{u=15} (u-C)^2|f(u)|^2}{\sum_{u=0}^{u=15} |f(u)|^2}$$

$$SRF = \max\left(h \left| \sum_{u=0}^{h} f(u) < 0.85 * \sum_{u=0}^{15} f(u)\right.\right)$$

20. The method of claim 12, wherein the determining of the input signal to be the vocal sound comprises:

training a neural network by inputting predetermined parameters including a zero-cross rate, time length ratios with respect to a voiced frame and unvoiced frame, statistical information of a pitch contour, and spectral characteristics from predetermined voice signals to the neural network and comparing an output of the neural network with a predetermined value so as to classify a signal having characteristics of the predetermined parameters as a voice signal;

extracting parameters including a zero-cross rate, time length ratios with respect to a voiced frame and unvoiced frame, statistical information of a pitch contour, and spectral characteristics from the input signal;

inputting the parameters extracted from the input signal to the trained neural network; and determining whether the input signal is the vocal sound by comparing an output of the neural network and the predetermined reference value.

21. The method of claim 12, wherein the determining of the vocal sound further comprises synchronizing the parameters.

22. A non-transitory medium storing computer-readable instructions that control at least one computing device to perform a method for distinguishing a vocal sound, the method comprising:

dividing an input signal into frames, each frame having a predetermined length;

determining whether each frame is a voiced frame or an unvoiced frame and extracting a pitch contour of the frame;

calculating a zero-cross rate for each frame;

calculating parameters including time length ratios with respect to the determined voiced frame and unvoiced frame, statistical information of the pitch contour, and spectral characteristics, wherein the time length ratio includes a local V/U time length ratio, which is a time length ratio of a single voiced frame to a single unvoiced frame, and a total V/U time length ratio, which is a time length ratio of total voiced frames to total unvoiced frames;

determining whether the input signal is the vocal sound using the calculated parameters, the calculated parameters are the zero-cross rate, the local V/U time length ratio, the total V/U time length ratio, the statistical information, and the spectral characteristics, wherein the method is performed using at least one computing device.

23. The medium of claim 22, wherein the calculating of the time length ratio comprises calculating the local V/U time length ratio and the total V/U time length ratio.

24. The medium of claim 23, wherein the numbers of voiced and unvoiced frames accumulated and counted to calculate the total V/U time length ratio are reset whenever a new signal is input or whenever a preceding signal segment is ended and the numbers of voiced and unvoiced frames accumulated and counted to calculate the local V/U time length ratio are reset whenever the input signal transitions from the voiced frame to the unvoiced frame.

25. The medium of claim 24, wherein the total V/U time length ratio is updated once every frame and the local V/U time length ratio is updated whenever the input signal transitions from the voiced frame to the unvoiced frame.

26. The medium of claim 22, wherein the statistical information of the pitch contour comprises a mean and variance of the pitch contour and the mean and variance of the pitch contour are initialized whenever a new signal is input or whenever a preceding signal segment is ended.

27. The medium of claim 26, wherein initialization of the mean and variance of the pitch contour is performed with a pitch value of a first frame and a square of the pitch value of the first frame, respectively.

28. The medium of claim 27, wherein the mean and the variance of the pitch contour are updated as follows:

$$u(Pt, t) = u(Pt, t-1) * \frac{N-1}{N} + Pt * \frac{1}{N}$$

$$u2(Pt, t) = u2(Pt, t-1) * \frac{N-1}{N} + Pt * Pt * \frac{1}{N}$$

$$\mathrm{var}(Pt, t) = u2(Pt, t) - u(Pt, t) * u(Pt, t)$$

where, u(Pt, t) indicates a mean of the pitch contour at time t, N indicates the number of counted frames, u2(Pt, t) indicates a square value of the mean, var(Pt, t) indicates a variance of the pitch contour at time t, and a pitch contour Pt indicates a pitch value when an input frame is a voiced frame and zero when the input frame is an unvoiced frame.

29. The medium of claim 22, wherein the spectral characteristics include a centroid, a bandwidth, and/or a spectral roll-off frequency with respect to an amplitude spectrum of the pitch contour, and performing a fast Fourier transform (FFT) of the amplitude spectrum of the pitch contour, and obtaining the centroid C, the bandwidth B, and the spectral roll-off frequency (SRF) with respect to a result f(u) of the FFT as follows:

$$C = \frac{\sum_{u=0}^{u=15} u|f(u)|^2}{\sum_{u=0}^{u=15} |f(u)|^2}$$

-continued $$B = \frac{\sum_{u=0}^{u=15} (u-C)^2|f(u)|^2}{\sum_{u=0}^{u=15} |f(u)|^2}$$

$$SRF = \max\left\{h \,\middle|\, \sum_{u=0}^{h} f(u) < 0.85 * \sum_{u=0}^{15} f(u)\right\}$$

30. The medium of claim 22, wherein the determining of the input signal to be the vocal sound comprises:

training a neural network by inputting predetermined parameters including a zero-cross rate, time length ratios with respect to a voiced frame and unvoiced frame, statistical information of a pitch contour, and spectral characteristics from predetermined voice signals to the neural network and comparing an output of the neural network with a predetermined value so as to classify a signal having characteristics of the predetermined parameters as a voice signal;

extracting parameters including a zero-cross rate, time length ratios with respect to a voiced frame and unvoiced frame, statistical information of a pitch contour, and spectral characteristics from the input signal;

inputting the parameters extracted from the input signal to the trained neural network; and determining whether the input signal is the vocal sound by comparing an output of the neural network and the predetermined reference value.

31. The medium of claim 22, wherein the determining of the vocal sound further comprises synchronizing parameters.

* * * * *

UNITED STATES PATENT AND TRADEMARK OFFICE

CERTIFICATE OF CORRECTION

PATENT NO. : 8,078,455 B2
APPLICATION NO. : 11/051475
DATED : December 13, 2011
INVENTOR(S) : Shi et al.

It is certified that error appears in the above-identified patent and that said Letters Patent is hereby corrected as shown below:

In the Claims

Column 11, Line 57, In Claim 8, delete "at time," and insert -- a t time --, therefor.

Signed and Sealed this
Eighth Day of July, 2014

Michelle K. Lee

Michelle K. Lee
*Deputy Director of the United States Patent and Trademark Office*